US010290454B2

(12) United States Patent
Dolecek et al.

(10) Patent No.: US 10,290,454 B2
(45) Date of Patent: May 14, 2019

(54) ELECTRONIC SWITCHING DEVICE INCLUDING A LOCKABLE ROTARY HANDLE HAVING A POSITION OFF FEATURE

(71) Applicant: Siemens Aktiengesellschaft, Munich (DE)

(72) Inventors: Antonin Dolecek, Letohrad (CZ); Ladislav Dostal, Zamberk (CZ)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 15/649,714

(22) Filed: Jul. 14, 2017

(65) Prior Publication Data

US 2018/0025878 A1 Jan. 25, 2018

(30) Foreign Application Priority Data

Jul. 22, 2016 (EP) ..... 16180811

(51) Int. Cl.
*H01H 9/20* (2006.01)
*H01H 9/22* (2006.01)
(Continued)

(52) U.S. Cl.
CPC ..... *H01H 71/56* (2013.01); *H01H 9/20* (2013.01); *H01H 9/22* (2013.01); *H01H 9/281* (2013.01);
(Continued)

(58) Field of Classification Search
CPC ..... H01H 71/56; H01H 71/565; H01H 9/20; H01H 2009/288
(Continued)

(56) References Cited

U.S. PATENT DOCUMENTS 4,160,137 A 7/1979 Clement et al.
7,342,189 B2 * 3/2008 Bravard ..... H01H 71/501 200/43.01
2009/0173611 A1 * 7/2009 Suter ..... H01H 3/3026 200/336

FOREIGN PATENT DOCUMENTS

CN 201084572 Y 7/2008
CN 101459009 A 6/2009
(Continued)

OTHER PUBLICATIONS

Extended European Search Report 16180811.8 dated Dec. 7, 2016.
Office Action for Chinese Patent Application No. 201710604091.3 dated Oct. 9, 2018 and English translation thereof.

*Primary Examiner* — Vanessa Girardi
(74) *Attorney, Agent, or Firm* — Harness, Dickey & Pierce, P.L.C.

(57) ABSTRACT

An electronic switching device includes a housing with at least one housing door, a lockable rotary handle rotatable at least between an ON position and an OFF position, a handle locking device for locking the rotary handle at least in the OFF position when engaged, and a POFF device for preventing the rotary handle to be rotated and/or fixed in OFF position when activated. The electronic switching device further includes a locking coulisse, movably arranged at the electronic switching device and arrangeable in at least a first position, a second position and a third positions with respect to the housing of the electronic switching device. The locking coulisse is configured for allowing an engagement of the handle locking device and the POFF device in the first position, locking the housing door in the second position and blocking the activation of the handle locking device in the third position.

20 Claims, 4 Drawing Sheets

(51) Int. Cl.

| | |
|---|---|
| ***H01H 9/28*** | (2006.01) |
| ***H01H 71/02*** | (2006.01) |
| ***H01H 71/04*** | (2006.01) |
| ***H01H 71/52*** | (2006.01) |
| ***H01H 71/56*** | (2006.01) |

(52) U.S. Cl.
CPC ..... *H01H 71/02* (2013.01); *H01H 71/04* (2013.01); *H01H 71/52* (2013.01); *H01H 71/521* (2013.01); *H01H 2009/288* (2013.01); *H01H 2071/565* (2013.01)

(58) Field of Classification Search
USPC ..... 200/331, 336, 50.11, 50.03
See application file for complete search history.

(56) References Cited

FOREIGN PATENT DOCUMENTS

| | | | |
|---|---|---|---|
| DE | 4312428 | C1 | 11/1994 |
| DE | 4439374 | C1 | 2/1996 |

* cited by examiner

ELECTRONIC SWITCHING DEVICE INCLUDING A LOCKABLE ROTARY HANDLE HAVING A POSITION OFF FEATURE

PRIORITY STATEMENT

The present application hereby claims priority under 35 U.S.C. § 119 to European patent application number EP16180811.8 filed Jul. 22, 2016, the entire contents of which are hereby incorporated herein by reference.

FIELD

At least one embodiment of the invention generally relates to an electronic switching device, in particular to an electronic circuit breaker, with a lockable rotary handle.

BACKGROUND

There is a plurality of different types of switching devices, such as electric circuit breakers, known from the prior art. A very common type of switching device includes a rotary handle for being operated. Such switching devices are also denominated as rotary handle operator switching devices or RHO-devices.

For safety reasons, common RHO-devices include safety features restricting the operation of the RHO-device to avoid accidents caused by an unauthorized operation of the switching device. For example, when the rotary handle of a circuit breaker is set in an OFF position, e.g. because of maintenance work at an electronic circuit, one has to make sure that the rotary handle is not moved to an ON position during the maintenance work, in order to avoid an electric shock for the maintenance worker. For this reason, common circuit breakers include a locking mechanism for locking the rotary handle at least in the OFF position.

Moreover, in order to avoid an unauthorized operation of an electronic switching device, some switching devices include a locking mechanism for locking the rotary handle at least in the ON position. Furthermore, another known safety feature disables locking the rotary handle in the OFF position or even prevents moving the rotary handle to the OFF position in the case of a short circuit, especially when the main contacts of the electronic switching device are welded together.

SUMMARY

The inventors have recognized that common electronic switching devices have a disadvantage, wherein these safety features are implemented by independent mechanisms, causing the electronic switching device to be very complex and expensive to manufacture. Especially, the assembly of such electronic switching devices can be very complicated due to a large number of small parts and a high complexity of the electronic switching device. As a consequence, costs for these electronic switching devices are relatively high and production is very time-consuming.

At least one embodiment of the present invention provides an improved electronic switching device that does not have at least one of the afore-mentioned drawbacks of the state of the art. At least one embodiment of the present invention is especially directed to providing an electronic switching device that has a reduced complexity, is easier to assemble, and is cheaper in production.

The claims describe example embodiments of the invention.

At least one embodiment of the invention is directed to an electronic switching device, comprising a housing with at least one housing door, a lockable rotary handle, rotatable at least between an ON position and an OFF position, a handle locking device for locking the rotary handle at least in the OFF position when the handle locking device is engaged, and a POFF device for preventing the rotary handle to be rotated and/or fixed in OFF position when the POFF device is activated. The electronic switching device further includes a locking coulisse that is movably arranged at the electronic switching device and arrangeable in at least a first position, a second position and a third positions with respect to the housing of the electronic switching device, wherein the locking coulisse is configured for allowing an engagement of the handle locking device and the POFF device in the first position, locking the housing door in the second position and blocking the activation of the handle locking device in the third position.

BRIEF DESCRIPTION OF THE DRAWINGS

The present invention is further described hereinafter with reference to an illustrated embodiment shown in the accompanying drawings, in which.

DETAILED DESCRIPTION OF THE EXAMPLE EMBODIMENTS

Figure 1:
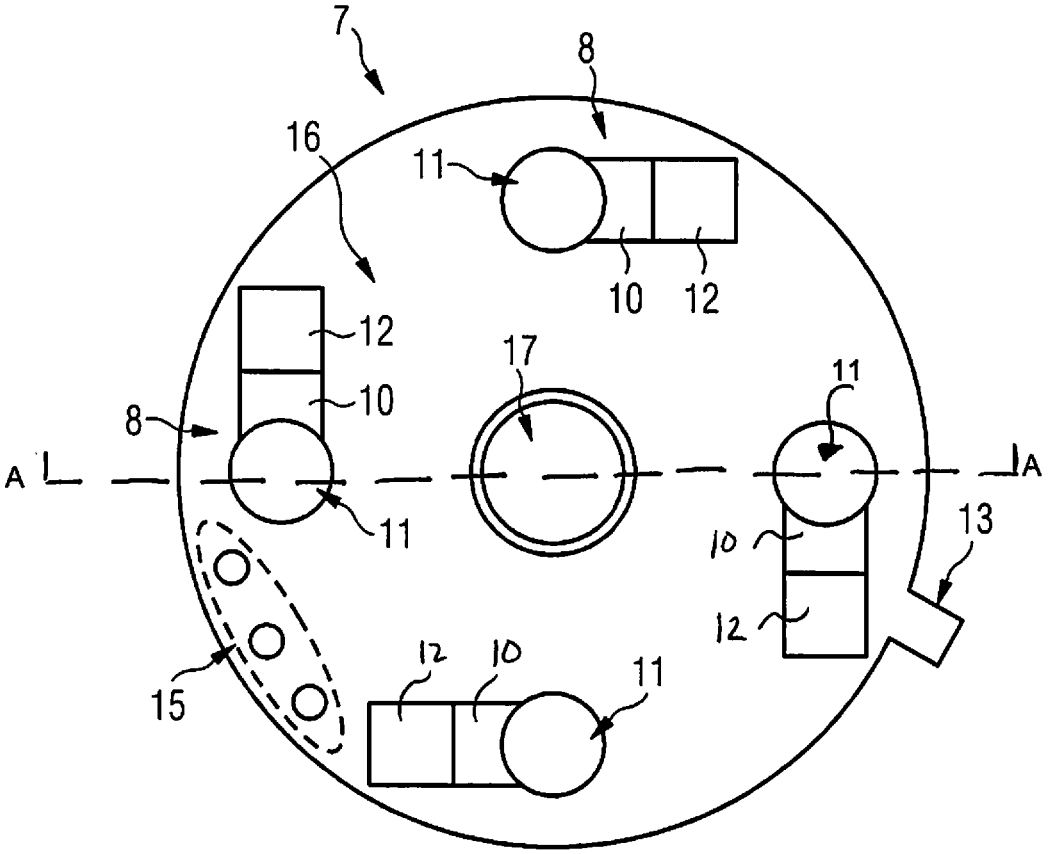
FIG. 1 illustrates schematically, in a top view, an example embodiment of the locking coulisse.

In the following, embodiments of the invention are described in detail with reference to the accompanying drawings. It is to be understood that the following description of the embodiments is given only for the purpose of illustration and is not to be taken in a limiting sense. It should be noted that the drawings are to be regarded as being schematic representations only, and elements in the drawings are not necessarily to scale with each other. Rather, the representation of the various elements is chosen such that their function and general purpose become apparent to a person skilled in the art.

The drawings are to be regarded as being schematic representations and elements illustrated in the drawings are not necessarily shown to scale. Rather, the various elements are represented such that their function and general purpose become apparent to a person skilled in the art. Any connection or coupling between functional blocks, devices, components, or other physical or functional units shown in the drawings or described herein may also be implemented by an indirect connection or coupling. A coupling between components may also be established over a wireless connection. Functional blocks may be implemented in hardware, firmware, software, or a combination thereof.

Various example embodiments will now be described more fully with reference to the accompanying drawings in which only some example embodiments are shown. Specific structural and functional details disclosed herein are merely representative for purposes of describing example embodiments. Example embodiments, however, may be embodied in various different forms, and should not be construed as being limited to only the illustrated embodiments. Rather, the illustrated embodiments are provided as examples so that this disclosure will be thorough and complete, and will fully convey the concepts of this disclosure to those skilled in the art. Accordingly, known processes, elements, and techniques, may not be described with respect to some example embodiments. Unless otherwise noted, like reference characters denote like elements throughout the attached drawings and written description, and thus descriptions will not be repeated. The present invention, however, may be embodied in many alternate forms and should not be construed as limited to only the example embodiments set forth herein.

It will be understood that, although the terms first, second, etc. may be used herein to describe various elements, components, regions, layers, and/or sections, these elements, components, regions, layers, and/or sections, should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items. The phrase "at least one of" has the same meaning as "and/or".

Spatially relative terms, such as "beneath," "below," "lower," "under," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below," "beneath," or "under," other elements or features would then be oriented "above" the other elements or features. Thus, the example terms "below" and "under" may encompass both an orientation of above and below. The device may be otherwise oriented (rotated 90 degrees or at other orientations) and the spatially relative descriptors used herein interpreted accordingly. In addition, when an element is referred to as being "between" two elements, the element may be the only element between the two elements, or one or more other intervening elements may be present.

Spatial and functional relationships between elements (for example, between modules) are described using various terms, including "connected," "engaged," "interfaced," and "coupled." Unless explicitly described as being "direct," when a relationship between first and second elements is described in the above disclosure, that relationship encompasses a direct relationship where no other intervening elements are present between the first and second elements, and also an indirect relationship where one or more intervening elements are present (either spatially or functionally) between the first and second elements. In contrast, when an element is referred to as being "directly" connected, engaged, interfaced, or coupled to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Also, the term "exemplary" is intended to refer to an example or illustration.

When an element is referred to as being "on," "connected to," "coupled to," or "adjacent to," another element, the element may be directly on, connected to, coupled to, or adjacent to, the other element, or one or more other intervening elements may be present. In contrast, when an element is referred to as being "directly on," "directly connected to," "directly coupled to," or "immediately adjacent to," another element there are no intervening elements present.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Before discussing example embodiments in more detail, it is noted that some example embodiments may be described with reference to acts and symbolic representations of operations (e.g., in the form of flow charts, flow diagrams, data flow diagrams, structure diagrams, block diagrams, etc.) that may be implemented in conjunction with units and/or devices discussed in more detail below. Although discussed in a particularly manner, a function or operation specified in a specific block may be performed differently from the flow specified in a flowchart, flow diagram, etc. For example, functions or operations illustrated as being performed serially in two consecutive blocks may actually be performed simultaneously, or in some cases be performed in reverse order. Although the flowcharts describe the operations as sequential processes, many of the operations may be performed in parallel, concurrently or simultaneously. In addition, the order of operations may be re-arranged. The processes may be terminated when their operations are completed, but may also have additional steps not included in the figure. The processes may correspond to methods, functions, procedures, subroutines, subprograms, etc.

Specific structural and functional details disclosed herein are merely representative for purposes of describing example embodiments of the present invention. This invention may, however, be embodied in many alternate forms and should not be construed as limited to only the embodiments set forth herein.

Although described with reference to specific examples and drawings, modifications, additions and substitutions of example embodiments may be variously made according to the description by those of ordinary skill in the art. For example, the described techniques may be performed in an order different with that of the methods described, and/or components such as the described system, architecture, devices, circuit, and the like, may be connected or combined to be different from the above-described methods, or results may be appropriately achieved by other components or equivalents.

At least one embodiment of the invention is directed to an electronic switching device, comprising a housing with at least one housing door, a lockable rotary handle, rotatable at least between an ON position and an OFF position, a handle locking device for locking the rotary handle at least in the OFF position when the handle locking device is engaged, and a POFF device for preventing the rotary handle to be rotated and/or fixed in OFF position when the POFF device is activated. The electronic switching device further includes a locking coulisse that is movably arranged at the electronic switching device and arrangeable in at least a first position, a second position and a third positions with respect to the housing of the electronic switching device, wherein the locking coulisse is configured for allowing an engagement of the handle locking device and the POFF device in the first position, locking the housing door in the second position and blocking the activation of the handle locking device in the third position.

In an example embodiment, the housing is configured for protecting electronic components of the electronic switching device from external influences, e.g. dust, water or the like. Moreover, in an example embodiment, the housing is configured to protect the environment of the electronic switching device, especially preventing a person from getting too close to the electronic components of the electronic switching device to avoid an electric shock. Therefore, it is preferred that the housing includes a material with good electrical insulation properties.

The housing door is preferably arranged at the housing in a way, that an interior of the housing is accessible with the housing door open and is not accessible with the housing door closed. Moreover, it is preferred that the housing door is lockable at least in the closed state of the housing door. Preferably, the housing and/or housing door include a window, so that at least a part of the interior of the housing is visible through the window when the housing door is in the closed state. Preferably, a position of the locking coulisse is visible through the window. The rotary handle is preferably attached outside the housing door.

The electronic switching device is operable via the rotary handle. The rotary handle is rotatable relative to the housing of the electronic switching device at least between the ON position (a position where a circuit of the switching device is closed), and an OFF position (a position where the circuit of the switching device is opened). In a variation of the switching device, the rotary handle can be operated with more than one ON position and/or more than one OFF position. With more than one ON position, different circuits of the electronic switching device can be closed separately and/or together.

The locking device is configured for locking the rotary handle at least in the OFF position in order to avoid an unauthorized operation of the rotary handle from the OFF position to the ON position, especially to avoid an electric shock of a maintenance worker. It is preferred that the locking device is further configured for locking the rotary handle in the ON position in order to avoid an unauthorized operation of the rotary handle from the ON position to the OFF position. Thus, it can be avoided that an unauthorized person opens a closed electric circuit and thereby e.g. shuts down an electronic system. It is preferred that the locking device include a padlock interface for inserting a padlock, when the locking device is activated, thus preventing a deactivation of the locking device.

POFF is an abbreviation for "positive OFF". An electronic switching device, like an electronic circuit breaker, can be in a state of a short circuit. In such state, main contacts of the electronic switching device can even be welded together. In this state, for safety reasons, it must be avoided that the rotary handle is moved from the ON position to the OFF position and/or that the rotary handle is locked in the OFF position by the locking device. The POFF device is configured for preventing such movement and/or locking the rotary handle in OFF position in this state of the electronic switching device.

According to at least one embodiment of the invention, the electronic switching device includes a locking coulisse that is preferably arranged within the housing of the electronic switching device and moveable between at least a first position, a second position and a third position relative to the housing. It is preferred that the first position is in between the second position and the third position. In other words, moving from the first position to the second position is possible without achieving the third position and moving from the first position to the third position is possible without achieving the second position. The locking coulisse is preferably designed as a one-piece part.

The first position of the locking coulisse can also be denominated "neutral" position. When the locking coulisse is in the first position, the locking coulisse allows the engagement of the handle locking device and the engagement of the POFF device. However, the locking coulisse is preferably configured such that simultaneous engagement of the handle locking device and POFF device is not possible.

The second position of the locking coulisse can also be denominated as a "door locking" position, because, in the second position, the housing door is locked by the locking coulisse. Thereby, the door can be locked by the locking coulisse directly or by a door locking device that is operated by the locking coulisse.

The third position of the locking coulisse can also be denominated as a "blocking" position, because, in the third position, the handle locking device, and thus locking of the rotary switch in the OFF position, is blocked by the locking coulisse.

The electronic switching device according to at least one embodiment of the invention has the advantage over conventional electronic switching devices, in that a plurality of safety features are combined within a single device, namely the locking coulisse. Thus, complexity as well as assembly and maintenance of the electronic switching device are improved. Furthermore, production costs and time of the electronic switching device are reduced.

It is preferred that the locking coulisse is rotatably mounted at the electronic switching device, wherein by rotating the locking coulisse, the at least first position, second position and third position is each achievable. It is preferred that the locking coulisse is rotatably mounted within the housing of the electronic switching device. For this purpose, the locking coulisse preferably includes a center hole, wherein a shaft of the electronic switching device may protrude through the center hole. Preferably, the rotary handle shaft is mounted onto the same shaft, wherein the shaft is rotatable together with the rotary handle. It is preferred that the locking coulisse has a substantially disc-shaped main body, wherein the center hole is preferably in the center of the main body. Such locking coulisse has the advantage that assembly is improved. Moreover, the positions of the locking coulisse can be easily achieved by respective rotation of the locking coulisse.

In a preferred embodiment of the invention, the locking coulisse includes a first engagement device, wherein the first engagement device is configured such that, in the first position of the locking coulisse, an activation of the handle locking device causes an engagement of the handle locking device with the first engagement device, thereby moving the locking coulisse from the first position to the second position. In other words, the first engagement device is configured for cooperation with the handle locking device in a way that the locking coulisse is moved from the first position to the second position, when the handle locking device is engaged. Preferably, the locking coulisse is kept in the second position by the first engagement device in cooperation with the handle locking device as long as the handle locking device is activated. This has the advantage that the housing door is automatically lockable, when the locking device is engaged.

Preferably, the handle locking device includes a locking pin, wherein the locking pin is configured for being pushed in a first direction for activating the handle locking device. Moreover, the first engagement device of the locking coulisse includes an inclined surface for being engaged by the locking pin when the locking pin is moved in the first direction, thereby causing the moving of the locking coulisse from the first position to the second position. It is preferred that the part of the locking pin that is configured for engaging with the inclined surface includes a rounded and/or smooth surface for reducing friction between the locking pin and the inclined surface. Such a mechanism is very simple to produce, easy to assemble and very reliable in use.

It can be advantageous that the first engagement device includes a locking hole for incorporating the locking pin of the handle locking device when the locking coulisse is arranged in the second position. Preferably, the locking hole has a diameter that is about a diameter of the locking pin. It is preferred that the locking hole is located adjacent to or within the inclined surface of the locking coulisse. By these devices, the locking coulisse can be reliably fixed in the second position by the locking pin of the handle locking device.

According to a preferred embodiment of the invention, the locking coulisse includes a blocking device, wherein the blocking device is arranged at the locking coulisse in a way that advancement of the locking pin in the first direction is blocked by the blocking device, when the locking coulisse is arranged in the third position. The blocking device is preferably arranged adjacent the inclined surface. The inclined surface is preferably arranged in between the locking hole and the blocking device. It is preferred that the blocking device includes a flat or concave surface for engaging with the locking pin. By way of the blocking device, activation of the handle locking device can be efficiently prevented, when the locking coulisse is in the third position due to activation of the POFF device.

Alternatively or additionally, the blocking device can be configured for blocking the rotary handle from being moved to OFF position, when the locking coulisse is in third position. For this purpose, the blocking device preferably includes at least one protrusion that is engageable with the rotary handle.

It is preferred that the locking coulisse includes a second engagement device, wherein the second engagement device is configured such that, in the first position of the locking coulisse, an activation of the POFF device causes an engagement of the POFF device with the second engagement device and thereby moving the locking coulisse from the first position to the third position. The second engagement device and the POFF device are preferably configured such that the locking coulisse is kept in the third position as long as the POFF device is activated. The second engagement device can e.g. include a tooth or pin that is engageable by a lever or pin of the POFF device. The second engagement device has the advantage, that movement of the locking coulisse from the first position to the third position and/or keeping the locking coulisse in the third position is ensured, when the POFF device is activated. Thus, activation of the handle locking device is securely blocked when the POFF device is activated.

Preferably, the locking coulisse includes a spring connector, wherein the spring connector is connected with a spring of the electronic switching device in a way that the spring is forcing the locking coulisse into the first position. Thus, the spring connector and spring are configured to move the locking coulisse from the second position to the first position when the activated handle locking device is deactivated. Moreover, the spring connector and spring are configured to move the locking coulisse from the third position to the first position when the activated POFF device is deactivated. This has the advantage, that the locking coulisse is kept in the first position, when neither the handle locking device nor the POFF locking device is activated, wherein, in the first position, the locking coulisse is ready for allowing the handle locking device or the POFF device to be activated.

According to a preferred embodiment of the invention, the locking coulisse includes an indicating device for indicating the adoption of the first position and/or the second position and/or the third position by the locking coulisse. This means that the indicating device indicates a position of the locking coulisse. Preferably, the indicating device includes a protrusion, dent, hole or the like for the first position and/or the second position and/or the third position of the locking coulisse. Preferably, the indicating device is configured for cooperation with a stationary pointing device of the electronic switching device. By these devices, movement of the locking coulisse causes a relative movement of the indicating device to the pointing device.

Such an indicating device has the advantage that a status of the electronic switching device is easily visible. An indication of the first position shows that the switching device is ON and an electric circuit closed. An indication of the second position shows that the switching device is OFF and the electric circuit opened. An indication of the third position shows that the POFF device is activated, especially due to a short circuit.

In at least one embodiment, the electric switching device is configured as an electronic circuit breaker. For electric circuit breakers, above-described safety features are very important. A circuit breaker according to at least one embodiment of the invention has the advantage over common circuit breaker that production time and production costs are reduced due to the locking coulisse in cooperation with the safety features of the circuit breaker.

It is preferred that the locking coulisse has a symmetrical shape or that at least one feature or a group of features of the locking coulisse, e.g. first engagement device, such as the inclined surface and the locking hole, second engagement device, blocking device or the like, is arranged symmetrically at the locking coulisse. Within the scope of at least one embodiment of the present invention, symmetrical arrangement means that at least the positions of a multiple existent feature, e.g. four locking holes, are distributed symmetrically over a face side of the locking coulisse. In the case of four locking holes, a space between adjacent locking holes would preferably be determined by 90°. This has the advantage that a single design of a locking coulisse can be used for different switching with different positions of the rotary handle, especially with respect to the location of the POFF device.

Hereinafter, an example embodiment for carrying out the present invention is described in detail. The example embodiment is described with reference to the drawings, wherein features with the same attributes are assigned to the same reference numerals. In the following description, for purpose of explanation, numerous specific details are set forth in order to provide a thorough understanding of an example embodiment. These details are not meant to delimit the scope of the invention in any way.

Figure 3:
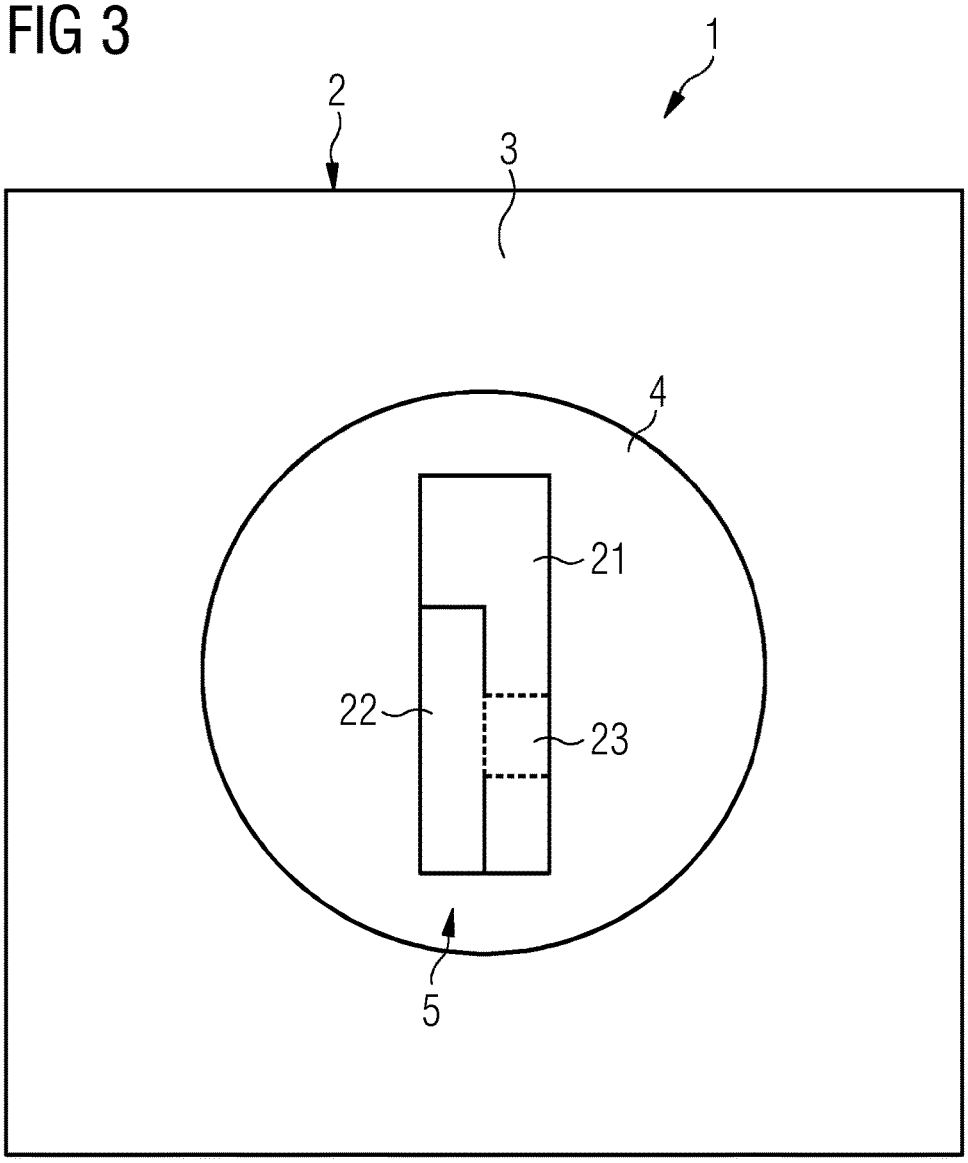
FIG. 3 illustrates schematically, in a top view, an example embodiment of a switching device.

FIG. 1 illustrates schematically an example embodiment of a locking coulisse 7 of a not shown electronic switching device 1 (c.f. FIG. 3) in a top view. In this figure, a top surface 16 of the locking coulisse 7 is shown. The locking coulisse 7 is substantially disc-shaped and includes a center hole 17 that is mountable onto a not shown rotary shaft for a rotary handle 4 (c.f. FIG. 3). With a distance of 90° degrees, the locking coulisse 7 includes four first engagement device 8, wherein each of the four first engagement device 8 includes a locking hole 11, an inclined surface 10 and a blocking device 12. The inclined surface 10 and the blocking device 12 are protruding from the top surface 16 of the locking coulisse 7. The function of the first engagement device 8 will be described later with respect to FIG. 4. Furthermore, the locking coulisse 7 includes a tooth-shaped second engagement device 13 protruding from a face side of the locking coulisse 7. The function of the second engagement device 13 will be described later with respect to FIG. 5. Moreover, an indicating device 15 is arranged at the top surface 16 of the locking coulisse 7 for indicating a first position, a second position and a third position of the locking coulisse 7 with respect to a not shown housing 2 (c.f. FIG. 3) of the electronic switching device 1.

Figure 2:
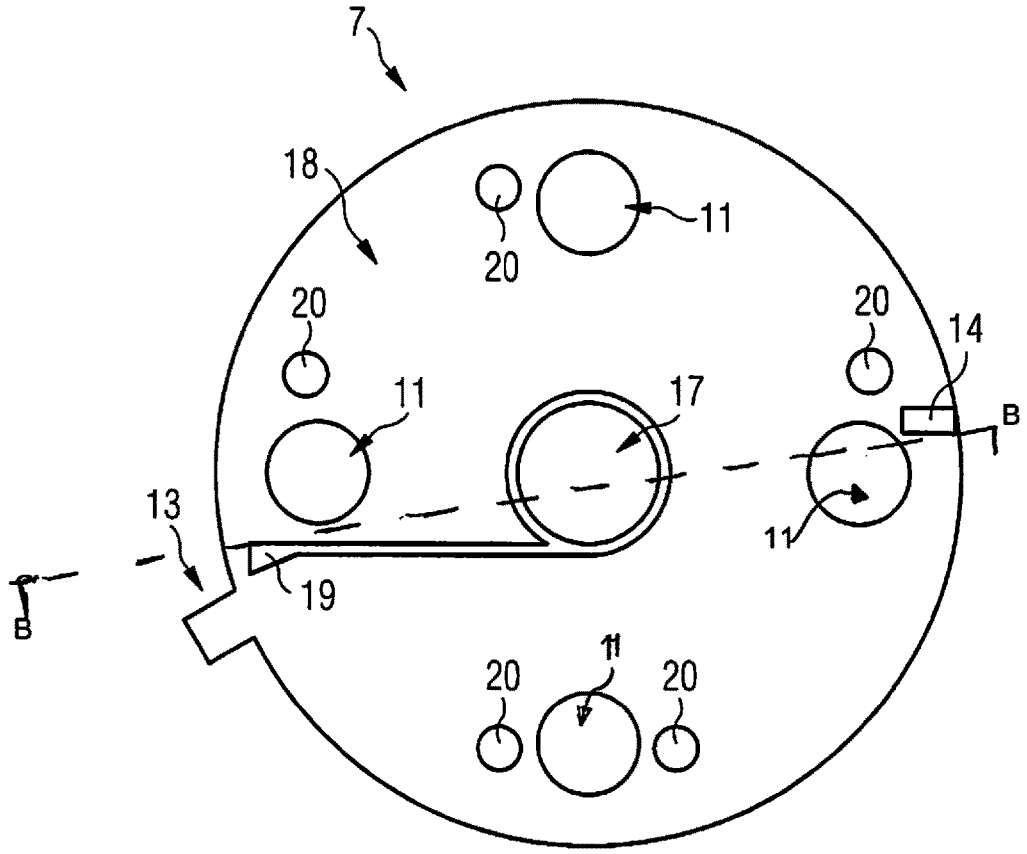
FIG. 2 illustrates schematically, in a bottom view, the locking coulisse of FIG. 1.

In FIG. 2, the locking coulisse 7 of FIG. 1 is schematically shown in a bottom view. In this figure, a bottom surface 18 of the locking coulisse 7 is shown. As can be derived from FIG. 1 and FIG. 2, the center bore 17 and the four locking holes 11 are configured as through-holes. A rib 19 is extending along the bottom surface 18 from the center hole 17 to a border area of the locking coulisse 7. The rib 19 is configured for blocking a not shown locking drawer of the electronic switching device 1, when the locking coulisse 7 is arranged in the third position. The locking drawer is configured for locking the rotary handle 4. When the locking drawer is blocked by the rib 19, the rotary handle 4 cannot be locked by the locking drawer. Furthermore, a few pins 20 for various functions protrude from the bottom surface 18.

FIG. 3 shows schematically, in a top view, an example embodiment of a switching device 1. The switching device 1 includes a housing 2 and a lockable housing door 3 for protecting an interior of the housing 2 from environmental influences as well as protecting an environment from electric shock from interior components of the switching device 1. In this embodiment, on top of the housing door 3, a rotary handle 4 for operating the switching device 1 is mounted. The rotary handle 4 can be rotated at least between an ON position and an OFF position. The rotary handle 4 includes a handle part 21 for operating the rotary handle 4 and a handle locking device 5 for locking the rotary handle 4 at least in OFF position. A visible part of the handle locking device 5 is configured as pushbutton 22. In an unlocked state, the pushbutton 22 blocks a padlock hole 23 of the handle part 21 from one side. In this unlocked state of the rotary handle 4, a padlock cannot be inserted through the padlock hole 23. The pushbutton 22 of the handle locking device 5 is configured to be pushed in direction of the plane of projection, thereby locking the rotary handle 4 and clearing the padlock hole 23. In this locked state of the rotary handle 4, the padlock can be inserted through the padlock hole 23.

Figure 4:
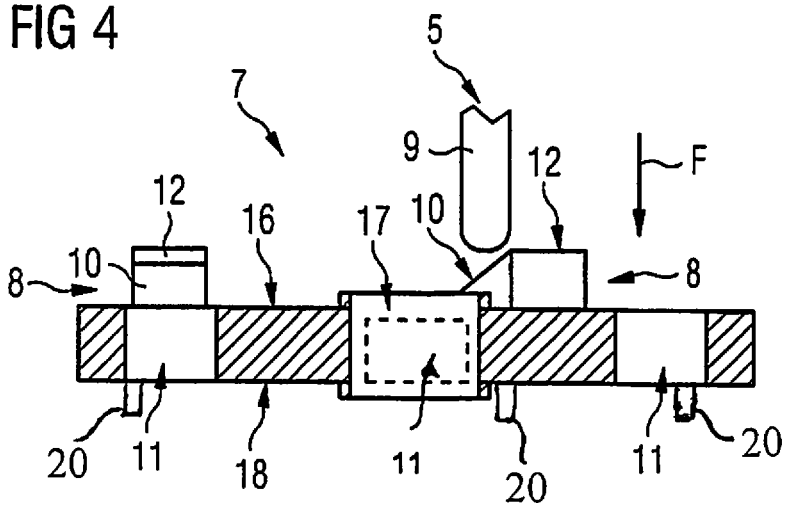
FIG. 4 illustrates schematically, in a first side view along line A of FIG. 1, the locking coulisse of FIG. 1 in cooperation with a handle locking device 5 of the electronic switching device 1.

In FIG. 4, the locking coulisse 7 of FIG. 1 is illustrated schematically in a first side view along line A of FIG. 1, in cooperation with a handle locking device 5 of the electronic switching device 1. Only an end portion of the handle locking device 5 is shown in this figure. The locking coulisse 7 is in the first position. A locking pin 9 of the handle locking device 5 is moved in a first direction F and thereby engaging the inclined surface 10 of the first engagement device 8. The locking pin 9 is guided along its longitudinal axis in a way that due to the engagement of the locking pin 9 with the inclined surface 10, the locking coulisse 7 is rotated from the first position to the second position with respect to the housing 2 of the electronic switching device 1. In the second position of the locking coulisse 7, the locking pin 9 extends into the locking hole 11 of the first engagement device 8. In case the locking coulisse 7 is rotated in the third position beforehand, the blocking device 12 of the first engagement device 8 is located on the axis of the locking pin 9 and thereby preventing the locking pin 9 from further advancement in the first direction F. In this state, locking of the rotary handle 4 via the handle locking device 5 is not possible.

Figure 5:
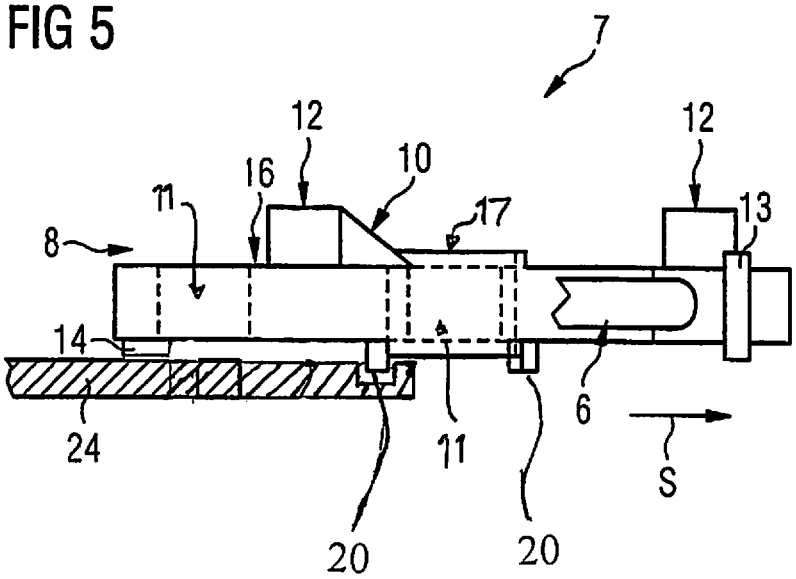
FIG. 5 illustrates schematically, in a reverse side view along line B of FIG. 2, the locking coulisse of FIG. 1 in cooperation with a POFF device 6 of the electronic switching device 1.

FIG. 5 illustrates schematically, in a reverse side view along line B of FIG. 2 the locking coulisse 7 of FIG. 1 in cooperation with a POFF device 6. Only an end portion of the POFF device 6 is shown in this figure. The locking coulisse 7 is in the first position. When activated, the POFF device 6 advances in a second direction S, thereby engaging the tooth-shaped second engagement device 13 of the locking coulisse 7 and thus moving the locking coulisse 7 from the first position to the third position with respect to the housing 2 of the electronic switching device 1. The pin 20 protruding from the bottom surface 18 of the locking coulisse 7 is coupled with a doorlock bar 24 of the electronic switching device 1. In this embodiment, the doorlock bar 24 and the locking coulisse 7 are configured such that in the first position and the third position of the locking coulisse 7, the housing door 3 is unlocked and in the second position of the locking coulisse 7, the housing door 3 is locked by the doorlock bar 24.

The patent claims of the application are formulation proposals without prejudice for obtaining more extensive patent protection. The applicant reserves the right to claim even further combinations of features previously disclosed only in the description and/or drawings.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

None of the elements recited in the claims are intended to be a means-plus-function element within the meaning of 35 U.S.C. § 112(f) unless an element is expressly recited using the phrase "means for" or, in the case of a method claim, using the phrases "operation for" or "step for."

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

REFERENCE NUMBER LIST

1 electronic switching device
2 housing
3 housing door
4 rotary handle
5 handle locking device
6 POFF device
7 locking coulisse
8 first engagement device
9 locking pin
10 inclined surface
11 locking hole
12 blocking device
13 second engagement device
14 spring connector
15 indicating device
16 top surface
17 center hole
18 bottom surface
19 rib
20 pin
21 handle part
22 pushbutton
23 padlock hole
24 doorlock bar
F first direction
S second direction

What is claimed is:

1. An electronic switching device, comprising:
a housing including at least one housing door;
a lockable rotary handle, rotatable at least between an ON position and an OFF position;
a handle locking device to lock the lockable rotary handle at least in the OFF position when the handle locking device is engaged;
a positive OFF (POFF) device to prevent the lockable rotary handle from being at least one of rotated and fixed in the OFF position when the POFF device is activated; and
a locking coulisse, movably arranged at the electronic switching device and arrangeable in at least a first position, a second position and a third position with respect to the housing of the electronic switching device, the locking coulisse being configured to
engage, with the locking coulisse in the first position, with the handle locking device and the POFF device,
lock the housing door in the second position, and
block activation of the handle locking device in the third position,
wherein the locking coulisse is rotatably mounted at the electronic switching device,
wherein the locking coulisse is rotatable to achieve the at least first position, second position and third achievable, and
wherein the locking coulisse includes a first engagement device, the first engagement device being configured such that, in the first position of the locking coulisse, an activation of the handle locking device causes an engagement of the handle locking device with the first engagement device and thereby movement of the locking coulisse from the first position to the second position.

2. The electronic switching device of claim 1, wherein the handle locking device includes a locking pin, the locking pin being configured to be pushed in a first direction for activating the handle locking device, and wherein the first engagement device of the locking coulisse includes an inclined surface configured to be engaged by the locking pin when the locking pin is moved in the first direction, thereby causing the moving of the locking coulisse from the first position to the second position.

3. The electronic switching device of claim 2, wherein the first engagement device includes a locking hole to incorporate the locking pin of the handle locking device when the locking coulisse is arranged in the second position.

4. The electronic switching device of claim 3, wherein the locking coulisse includes a blocking device, the blocking device being arranged at the locking coulisse such that advancement of the locking pin in the first direction is blocked by the blocking device, when the locking coulisse is arranged in the third position.

5. An electronic switching device, comprising:
a housing including at least one housing door;
a lockable rotary handle, rotatable at least between an ON position and an OFF position;
a handle locking device to lock the lockable rotary handle at least in the OFF position when the handle locking device is engaged;
a positive OFF (POFF) device to prevent the lockable rotary handle from being at least one of rotated and fixed in the OFF position when the POFF device is activated; and
a locking coulisse, movably arranged at the electronic switching device and arrangeable in at least a first position, a second position and a third positions with respect to the housing of the electronic switching device, the locking coulisse being configured to
engage, with the locking coulisse in the first position, with the handle locking device and the POFF device, lock the housing door in the second position, and block activation of the handle locking device in the third position, wherein the locking coulisse includes a first engagement device, the first engagement device being configured such that, in the first position of the locking coulisse, an activation of the handle locking device causes an engagement of the handle locking device with the first engagement device and thereby movement of the locking coulisse from the first position to the second position.

6. The electronic switching device of claim 5, wherein the locking coulisse includes a second engagement device, the second engagement device being configured such that, in the first position of the locking coulisse, an activation of the POFF device causes an engagement of the POFF device with the second engagement device, thereby moving the locking coulisse from the first position to the third position.

7. The electronic switching device of claim 5, wherein the locking coulisse includes a spring connector, the spring connector being connected with a spring of the electronic switching device such that the spring is configured to force the locking coulisse into the first position.

8. The electronic switching device of claim 5, wherein the locking coulisse includes an indicating device to indicate at least one of adoption of the first position, the second position and the third position by the locking coulisse.

9. The electronic switching device of claim 5, wherein the electric switching device is configured as an electronic circuit breaker.

10. The electronic switching device of claim 5, wherein the locking coulisse includes a second engagement device, the second engagement device being configured such that, in the first position of the locking coulisse, an activation of the POFF device causes an engagement of the POFF device with the second engagement device, thereby moving the locking coulisse from the first position to the third position.

11. The electronic switching device of claim 5, wherein the locking coulisse includes an indicating device to indicate at least one of adoption of the first position, the second position and the third position by the locking coulisse.

12. The electronic switching device of claim 5, wherein the electric switching device is configured as an electronic circuit breaker.

13. The electronic switching device of claim 5, wherein the locking coulisse is rotatably mounted at the electronic switching device and wherein the locking coulisse is rotatable to achieve the at least first position, second position and third achievable.

14. The electronic switching device of claim 13, wherein the locking coulisse includes a second engagement device, the second engagement device being configured such that, in the first position of the locking coulisse, an activation of the POFF device causes an engagement of the POFF device with the second engagement device, thereby moving the locking coulisse from the first position to the third position.

15. The electronic switching device of claim 13, wherein the locking coulisse includes an indicating device to indicate at least one of adoption of the first position, the second position and the third position by the locking coulisse.

16. The electronic switching device of claim 13, wherein the electric switching device is configured as an electronic circuit breaker.

17. The electronic switching device of claim 5, wherein the handle locking device includes a locking pin, the locking pin being configured to be pushed in a first direction for activating the handle locking device, and wherein the first engagement device of the locking coulisse includes an inclined surface configured to be engaged by the locking pin when the locking pin is moved in the first direction, thereby causing the moving of the locking coulisse from the first position to the second position.

18. The electronic switching device of claim 17, wherein the locking coulisse includes a blocking device, the blocking device being arranged at the locking coulisse such that advancement of the locking pin in the first direction is blocked by the blocking device, when the locking coulisse is arranged in the third position.

19. The electronic switching device of claim 17, wherein the first engagement device includes a locking hole to incorporate the locking pin of the handle locking device when the locking coulisse is arranged in the second position.

20. The electronic switching device of claim 19, wherein the locking coulisse includes a blocking device, the blocking device being arranged at the locking coulisse such that advancement of the locking pin in the first direction is blocked by the blocking device, when the locking coulisse is arranged in the third position.

* * * * *